United States Patent [19]

Kobayashi et al.

[11] Patent Number: 5,065,188

[45] Date of Patent: Nov. 12, 1991

[54] CHARGE-ELIMINATING APPARATUS OF COPIER

[75] Inventors: Hiroshi Kobayashi, Hachioji; Kazuhiko Tsuboi; Atsushi Takahashi, both of Hino; Shigeo Maeda, Machida; Seiichi Yagi, Shiroyama, all of Japan

[73] Assignee: Konica Corporation, Tokyo, Japan

[21] Appl. No.: 602,177

[22] Filed: Oct. 23, 1990

[30] Foreign Application Priority Data

Oct. 26, 1989 [JP] Japan ..... 1-278945

[51] Int. Cl.[5] ..... G03G 15/02

[52] U.S. Cl. ..... 355/219; 362/800

[58] Field of Search ..... 346/107 R; 355/219; 362/800

[56] References Cited

U.S. PATENT DOCUMENTS 4,721,977 1/1988 Fukae ..... 355/1 X 4,951,064 8/1990 Kun et al. ..... 346/107 R

*Primary Examiner*—A. T. Grimley

*Assistant Examiner*—P. Stanzione

*Attorney, Agent, or Firm*—Finnegan, Henderson, Farabow, Garrett and Dunner

[57] ABSTRACT

A charge eliminating device for use with a photoreceptor drum. The device eliminates a charge on a required portion of the surface of a photoreceptor drum so that an electrostatic latent image is eliminated on the required portion. The device includes a circuit board for holding an electrical circuit on its surface, the circuit board having a line-shaped edge disposed to face the surface of the photoreceptor drum. A plurality of light emitting elements are disposed on the circuit board to emit light in parallel to the surface of the circuit board in the direction of the line-shaped edge of the circuit board. The device further includes a housing having a plurality of compartments each of which encloses one of the plurality of light emitting elements on the circuit board and has an opening at the line-shaped edge for passing the emitted light in parallel to the surface of the circuit board to the surface of the photoreceptor.

9 Claims, 9 Drawing Sheets

CHARGE-ELIMINATING APPARATUS OF COPIER

BACKGROUND OF THE INVENTION

The present invention relates to a charge-eliminating apparatus which is used for eliminating electric charge on a photoreceptor drum of an image forming apparatus such as an electrostatic copier.

An image forming apparatus such as an electrostatic copier is composed in such a manner that: a charged photoreceptor (a photoreceptor drum will be explained hereafter as an example of the photoreceptor) is exposed to light according to the document information so that an electrostatic latent image can be formed; the electrostatic latent image is developed by toner so that it can be visualized; and the obtained toner image is transferred onto a transfer paper and fixed. Recently, this kind of image forming apparatus has been used in all industrial fields.

In order to prevent toner from adhering to a non-image zone which is a zone out of a region corresponding to an original document and an unnecessary pixel zone on the photoreceptor drum surface, a charge-eliminating apparatus is provided to the above kind of image forming apparatus to eliminate charge from the non-image zone and the unnecessary pixel zone on the photoreceptor drum surface by irradiating such zones. The charge-eliminating apparatus is composed of a plurality of light emitting elements and controlled to turn them on and off in accordance with a size of a document zone. In this case, light emitting diodes (which will be called LED hereafter) are generally used as the light emitting elements.

FIG. 15 is a side view which shows the composition of an image forming apparatus around a conventional charge-eliminating apparatus. The numeral 1 is a photoreceptor drum which composes an image carrier. The numeral 2 is an electrode which charges the photoreceptor drum 1 by corona discharge. The numeral 3 is a charge-eliminating apparatus which eliminates charge from the non-image zone on the photoreceptor drum 1. In the charge-eliminating apparatus 3, there are arranged a plurality of LEDs in the direction vertical to the drawing surface.

FIG. 16 is a schematic illustration which shows the composition of the charge-eliminating apparatus 3 in detail. The numeral 3*a* is a print substrate or a printed plate board on which the parts of the charge-eliminating apparatus are provided. The numeral 3*b* is a driver IC which drives a light source selectively. The numeral 3*c* is a lamp house which holds a plurality of LEDs composing the light source, and which separates a light flux emitted from one of the LEDs from another light flux emitted from the other one of the LEDs. The numeral 3*d* is the light source composed of a plurality of LEDs which are held by the lamp house 3*c*.

Recently there is now an increased demand for compact copiers. In accordance with the demand, the size of a photoreceptor drum which occupies a pretty wide space in a copier, has been reduced lately.

However, various kinds of parts are placed very closely around the photoreceptor drum of a copier. Further, it is anticipated that when the size of a photoreceptor drum is reduced, the parts are further crowded around the the photoreceptor drum surface. Consequently, the size of the charge-eliminating apparatus must be reduced.

However, in the case of a conventional charge-eliminating apparatus which emits light perpendicularly to the print substrate, the space to install the LED holding substrate is needed, so that it is difficult to reduce the size of the apparatus.

Consequently, even when there is a demand to use a photoreceptor drum of a small diameter, the size of the drum is limited by the size of a charge-eliminating apparatus, so that the image forming apparatus of a small size can not be realized.

It can be considered to use the bare chip type LED in order to reduce the size of a charge-eliminating apparatus. However, there is caused a problem even in this case.

FIG. 17 is a view of a charge-eliminating apparatus in which a bare chip LED is used, wherein the view is taken in the direction of emitted light. In the case of this drawing, 0.4 mm square bare chip LEDs are used. These bare chip LEDs are placed on an electrode at the cathode of a print substrate, and the anode side of the LEDs is connected with an electrode at the anode side of the print substrate through a wire (the electrodes on the print substrate are omitted in the drawing). When this type of charge-eliminating apparatus is manufactured, the lamp house 3*c* is mounted after the bare chip LEDs are provided to the print substrate by means of wire bonding. When the lamp house 3*c* is mounted, it should not come into contact with the wire of the bare chip LED, so that the size of the opening portion or window portion of the lamp house can not be reduced.

The problem is caused is that since the shape of the photoreceptor drum is cylindrical, the boundary of the charge-eliminating zone becomes vague. Namely, as illustrated in FIG. 18, the irradiating angle of the light emitted from a LED is extended, so that the incident angle upon the drum surface becomes large. As a result, the contour of the image zone and the non-image zone becomes vague, which can be a problem when a binding margin is required (the binding margin mode). FIG. 19 is a schematic illustration which shows the result of the binding margin copy operation. Charge-eliminating zone A lies at edges of the transfer paper and at the central portion of the transfer paper with regard to the direction (which is called the main-scanning direction) perpendicular to the drum rotating direction. The zones except this charge-eliminating zone A are charging zones (the image forming zone) B and C. In this case, image blurring zone D in the main-scanning direction is caused between the charge-eliminating zone and charging zone because of the aforementioned relation between the drum shape and the extended radiating angle.

Although not shown in FIG. 19, such image blurring zone D, of course, also takes place in the sub-scanning direction. This blurring zone D can be the cause of image deterioration.

The light amount distribution given to the surface of the photoreceptor drum 1 by the charge-eliminating apparatus 3 is shown in FIG. 20.

This graph shows the light amount distribution when the photoreceptor drum 1 is irradiated by six LEDs of A to F. The surface facing the front of a LED generally receives a large amount of light and the surface facing the position located between LEDs generally receives a small amount of light. According to the result of measurement, the difference of the amount of light between the above-described two surfaces is larger than 10%.

In this case, the apparatus is adjusted in such a manner that the minimum amount indicated as MIN of light emitted from LEDs can be the minimum amount of light which is necessary for eliminating charge. In this way charge-elimination can be conducted in all zones required to eliminate charge thereon. If charge-elimination is not carried out in some zones, there will be caused such problems that: the toner consumption is increased; and the image quality is deteriorated.

Furthermore, the excessively large amount of light is given to the portions on the photoreceptor drum surface except the portions to which the minimum amount of light is given, so that the fatigue of the photoreceptor drum 1 advances locally and its life is shortened. Further the power consumption of the charge-eliminating apparatus is uneconomically increased. Furthermore, the life of the charge-eliminating apparatus is shortened.

Even though there are the problems described above, the occurrence of the zones which are not charge-eliminated can not be permitted, so that the amount of light emitted from the charge-eliminating apparatus 3 is set at a large value which is sufficient for charge-elimination.

SUMMARY OF THE INVENTION

The present invention has been achieved in order to solve the above-described problems. The object of the present invention is to provide a charge-eliminating apparatus which is characterized in that: the charge-eliminating apparatus is compact and suitable for the photoreceptor drum of a small diameter; the contour of the charge-eliminating zone is made clear; and the photoreceptor drum is uniformly irradiated in terms of the amount of light.

The present invention has been achieved to solve the problems explained above. The present invention is to provide a charge-eliminating apparatus which is located so that it can face the surface of a photoreceptor drum and eliminates the unnecessary charge on the photoreceptor drum by irradiating the photoreceptor drum surface, and which comprises: an IC for driving a LED; a print substrate whose line-shaped edge surface faces the photoreceptor drum surface; a plurality of LEDs which are arranged on the print substrate in parallel with the above-described line-shaped edge face; an opening on the side of the line-shaped edge face of the print substrate; and a LED house having a partition at a predetermined position.

In the charge-eliminating apparatus of the present invention, the light generated by the LED is emitted in parallel with the print substrate surface and made incident upon the photoreceptor drum surface, so that the surface area in an image forming apparatus occupied by the charge-eliminating apparatus, becomes small. Since the light of the LED is emitted in parallel with the substrate, the surface area of the opening of the LED house can be reduced, so that the charge-eliminating apparatus can be made small. Further the extension of the emergent angle of the emitted light can be restricted, so that the contour of the charge-eliminating zone can be made clear.

DETAILED DESCRIPTION OF THE PREFERRED EMBODIMENT

Figure 1:
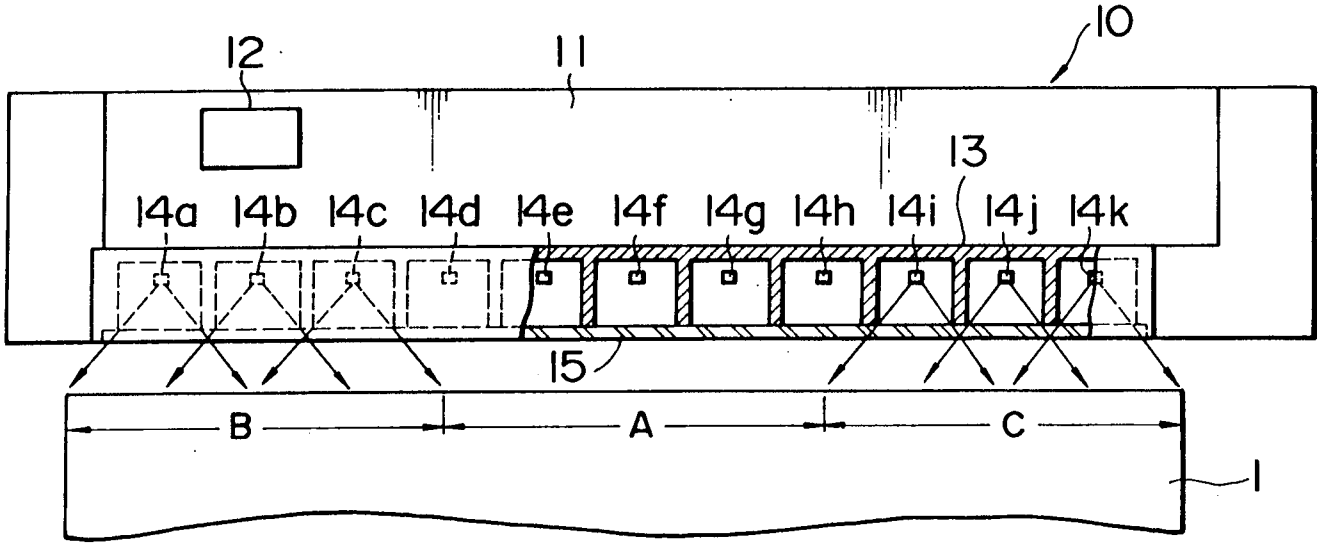
FIG. 1 is a view showing the composition of the first example of the charge-eliminating apparatus of the present invention.

Referring now to the drawings, an example of the present invention will be described as follows.

FIG. 1 is a view which shows the composition of an example of the charge-eliminating apparatus of the present invention.

In the drawing the numeral 11 is a print substrate on which the parts of the charge-eliminating apparatus are provided, wherein at least one edge surface of the print substrate is formed into a line-shaped surface. The numeral 12 is a driver IC which drives the light source selectively. The numeral 13 is a light emitting diode house (which will be called a LED house hereafter) which is provided to the print substrate 11 and has openings on the surface vertical to the print substrate 11 on the side of the above-described line-shaped edge face. The numerals 14*a* to 14*k* are LEDs which are placed on the print substrate 11 and emit light in parallel with the print substrate surface. The numeral 15 is a transparent LED cover which is provided to the opening of the LED house 13 in order to protect the LED from being stained by toner.

Figure 2:
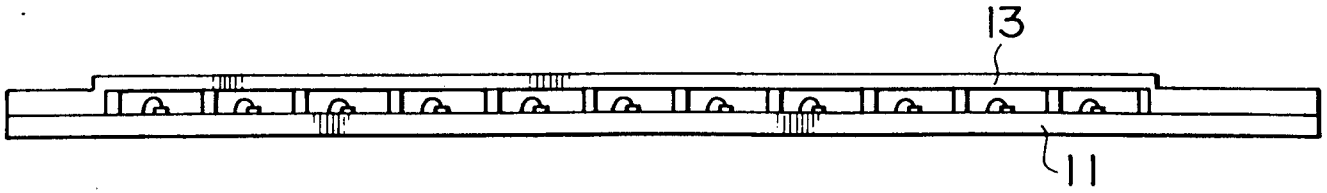
FIG. 2 is a front view showing the front of the example of the charge-eliminating apparatus illustrated in FIG. 1.

FIG. 2 is a front view of the charge-eliminating apparatus of the present invention, wherein the view is taken from the opening portion (the front) of the charge-eliminating apparatus.

Figure 3:
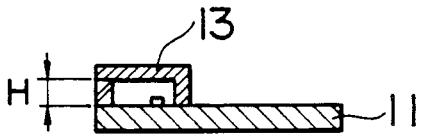
FIG. 3 is a sectional view of the example of the charge-eliminating apparatus illustrated in FIG. 1.

FIG. 3 is a sectional view of the charge-eliminating apparatus, wherein the view is taken in the axial direction of the photoreceptor drum 1.

In this case, an image zone A in FIG. 1 is determined on the effective image forming zone of the photoreceptor drum 1 in accordance with the document size and copy magnification. Zones B and C adjacent to the image zone A, are non-image zones.

The charge-eliminating apparatus 10 is composed in such a manner that: a plurality of chip LEDs are placed in the axial direction of the photoreceptor drum 1 over the width of the photoreceptor drum, wherein in the present invention the chip LED is defined as a bare chip LED and a surface packaged part LED. The chip LEDs irradiate the surface of the photoreceptor drum before an electrostatic latent image is developed in order to eliminate the charge in non-image zones B and C.

In this example the chip LEDs 14 are placed along the line-shaped edge surface of the print substrate 11 at a regular interval.

The LED house 13 has openings corresponding in number to the chip LEDs 14 so that the light emitted by the LEDs can advance in parallel with the surface of the print substrate 11.

As illustrated in FIG. 2 and FIG. 3, in the charge-eliminating apparatus of the invention, light is emitted in the direction parallel with the surface of the print substrate 11, so that height H of the openings (the irradiating windows) of the LED house can be made extremely low even though a certain clearance must be provided between the lead wire of the chip LED 14 and the LED house 13. In this way, the space occupied by the charge-eliminating apparatus 10 in an image forming apparatus can be made pretty small. As compared with the conventional charge-eliminating apparatuses such as an apparatus in which light is emitted by a mold LED in the direction parallel with the print substrate and an apparatus in which light is emitted by a bare chip LED in the direction vertical to the print substrate, it can be understood that the charge-eliminating apparatus of the present invention is made thin.

Figure 4:
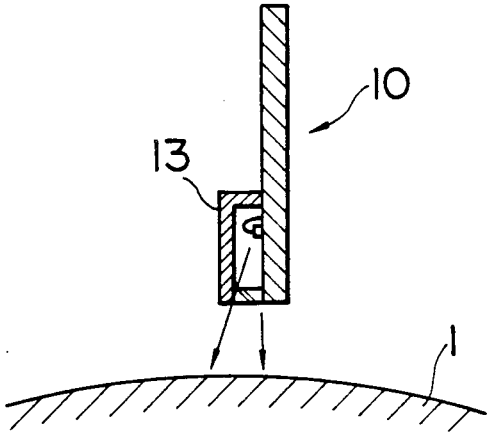
FIG. 4 is a schematic illustration which explains the irradiating angle of the charge-eliminating apparatus of the present invention.
Figure 5:
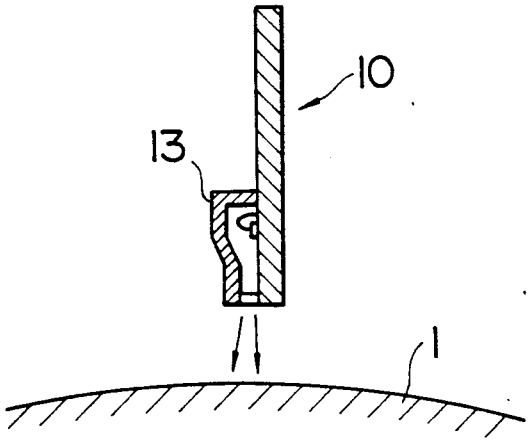
FIG. 5 is a schematic illustration showing another example of the irradiating angle of the charge-eliminating apparatus.

In the charge-eliminating apparatus of the invention, the invention does not only allow the apparatus to be made compact (thin), but the invention allows the extension of the irradiating angle to be made small. Since the light irradiating window of the charge-eliminating apparatus 10 is made small as illustrated in FIG. 4 (Height H of the irradiating window is restricted.), the incident angle to the photoreceptor drum 1 is small and there is caused an effect that the contour of the charge-eliminating zone is made clear. Therefore, when only an optional zone is charge-eliminated, the contour of the charge-eliminating zone can be made clear. In this case, it is preferable that height H of the window portion is 0.5 mm to 3.0 mm. The reason why is that: when height H becomes larger than 3.0 mm, the irradiating angle becomes too large; and when height H becomes smaller than 0.5 mm, the amount of light is excessively decreased. When height H is not more than 0.5 mm, since there is a fear that the amount of light is decreased to the value smaller than a predetermined value due to the stain caused by toner, it is not preferable. When height H of the window portion can not be reduced because of the height of the lead wire, the roof board of the LED house may be made stepwise as illustrated in FIG. 5. In this way the height of the window portion can be made low.

In the conventional charge-eliminating apparatus in which light is emitted in the vertical direction to the print substrate, the distance between the charge-eliminating apparatus and the photoreceptor drum 1 can not be set accurately due to the bend of the print substrate. Specifically, the distance between the LEDs placed in the central portion of the charge-eliminating apparatus and the photoreceptor drum 1 is different from the distance between the LEDs placed at the end portion of the charge-eliminating apparatus and the photoreceptor drum 1. On the other hand, in the case of the present invention, light irradiation is conducted in parallel with the print substrate, so that the error ascribed to the bend of the print substrate, is not caused. Further the charge-eliminating apparatus can be positioned very accurately with regard to the photoreceptor drum 1 in such a manner that the chip LEDs are positioned utilizing the line-shaped edge surface of the print substrate as the reference surface. Therefore, the amount of irradiating light can be controlled accurately.

As explained above, charge-elimination was conducted while the irradiation angle was made small, and the best result could be obtained when the charge-elimination was carried out under the following conditions.

| | |
|---|---|
| Size of the bare chip LED | 0.4 mm square |
| Interval between LEDs | 6 mm |
| Position of LED | 3 mm from the substrate edge |
| Thickness of LED house | 1 mm (uniform) |
| Thickness of LED cover | 0.5 mm |
| Reflectance inside LED house | Not more than 30% |
| Height of the window portion | 0.5 to 3.0 mm |

It is important to make the thickness of the LED house uniform in order to improve the accuracy. When the LED house is manufactured by the method of injection molding, melted polymer is poured into a metallic mold, and after it is cooled, it is removed from the mold. When the thickness of the LED house is uniform, the molded polymer is cooled and solidified uniformly. As a result, a LED house of high accuracy without distortion and warp can be obtained.

The following compounds and the complexes derived from these compounds are used as the material of the LED house.

Denatured PPE (Polyphenylene ether) / Polystyrene resin, PPE / PB (Polybutylene terephthalate), PPE / PET (Polyethylene terephthalate), PPE / PCT (Poly 1-4-Cyclohexane dimethylene terephthalate), Chemical resistant PPE (PPE / PA (Polyamide), Denatured PPE containing glass (0 to 40%), Polycarbonate (PC), Polyamide (PA), Polybutylene terephthalate (PBT), Polyethylene terephthalate (PET), Fiberglass reinforced PET (GF-PET), Poly 1-4-Cyclohexane dimethylene terephthalate (PCT), Polyacetal (POM), Polymethylene pentene (PMP), Fiberglass reinforced PMP (FRPMP), Ethylene vinyl alcohol copolymer )EVOH), Polyphenylene sulfide (PPS), Polyarylate (PAR), Polysulfone (PSF), Polyarylsulfone (PASF), Polyethersulfone (PES), Polyether imide (PEI), Ketone polymer (Polyether etherketone (PEEK), Polyketone), Imide polymer (Polyimide (PI), Polyamide imide (PAI), Fluorocarbon resin (Polytetra fluoro ethylene (PTFE), Acrylic acid resin, Liquid crystal polymer (LCP), and the like.

The following compounds can be used as the material of a LED cover.

Polycarbonate (PC), acrylic acid resin, Polyarylate (PAR), Liquid crystal polymer (LCP), Polybutylene terephthalate (PBT), Polyethylene terephthalate (PET), and the like.

When there is no fear of the stain caused by toner, the LED cover can be omitted.

The distribution of the amount of light can be made most adequate by adjusting the reflectance of the inner surface of the LED house 13. For instance, the inner surface of the LED house is formed to be white so that the light produced by the chip LED 14 can be reflected in the manner of diffuse reflection. The reason why the inner surface of the LED house is formed white is that the light emitted from the chip LED is effectively used being reflected by the inner surface so that the distribution of the amount of light can be made uniform on the surface of the photoreceptor drum 1. Specifically, when the inner surface of the LED house 13 is formed completely black, the light made incident on the inner surface of the LED house can not be used effectively, and when the light is reflected in the LED house in the manner of mirror reflection, the contour between the image zone and the non-image zone is not clear.

Since the apparatus has the structure described above, the uniform distribution of the amount of light can be achieved. Furthermore, the uniform distribution can be enhanced by improving the shape of the LED house 13, applying the most adequate reflectance to the inner surface of the LED house and positioning the LED at the most adequate position.

According to the experiment conducted by the inventors, the best result could be obtained under the following conditions.

| | |
|---|---|
| Interval of the chip LEDs | 6 mm |
| Position of the chip LEDs | 3 mm from the edge of the substrate |
| Thickness of the partition of the LED house (the portion which separates LEDs) | 1 mm |
| Thickness of the LED cover | 0.5 mm |
| Reflectance of the inner surface of the LED house | 80% |

Figure 6:
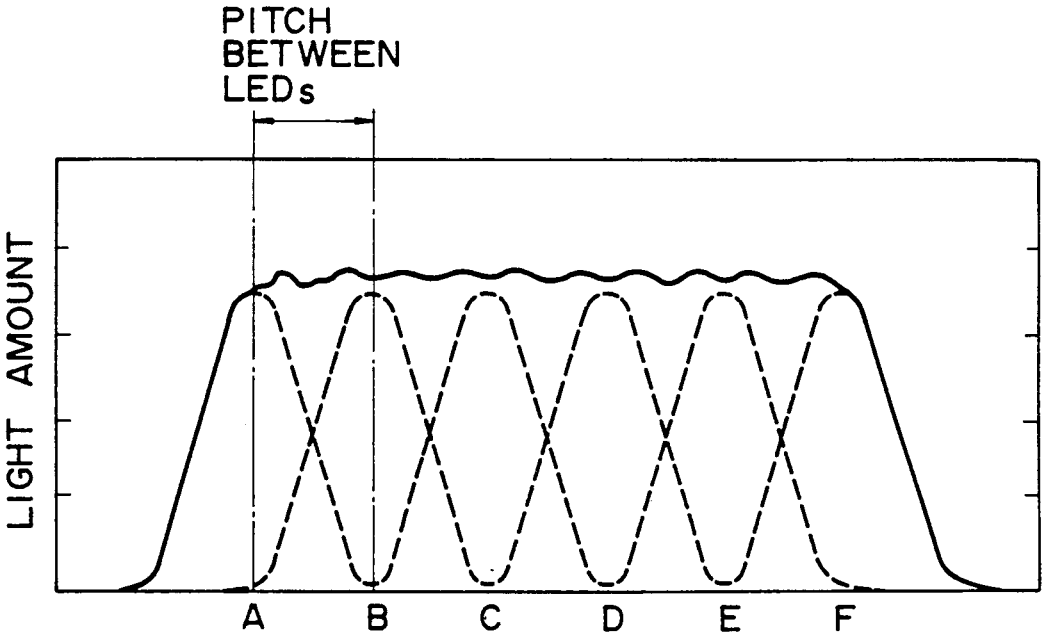
FIG. 6 is a characteristic diagram showing the characteristic of the distribution of the amount of light on the photoreceptor surface.

FIG. 6 is a characteristic diagram which shows the actual measurement results of the difference of the amount of light, wherein the above-described charge-eliminating apparatus was used. In this drawing, A to F represent the positions of six LEDs. According to the diagram, it is obvious that the difference of the amount of light was hardly produced. According to the actual measurement, the difference of the distribution of the amount of light was within the range of 10%.

Figure 7:
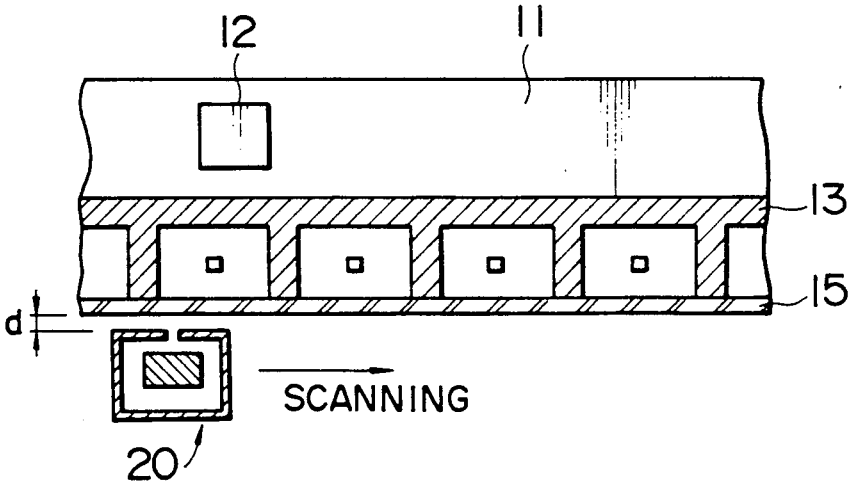
FIG. 7 is a schematic illustration showing a measuring apparatus which measures the distribution of the amount of light emitted by the charge-eliminating apparatus of the present invention.
Figure 8:
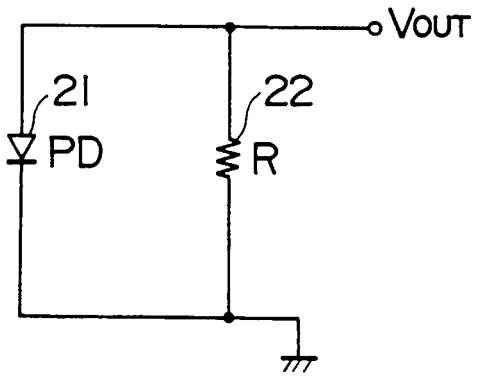
FIG. 8 is a circuit diagram which shows the circuit of the measuring apparatus.

FIG. 7 is a schematic illustration which depicts the state of the measurement of the distribution of the amount of light. As illustrated in the drawing, the measurement was conducted in such a manner that: the measuring unit 20 was moved for scanning at a constant speed while it faced the charge-eliminating apparatus. This measuring unit 20 is composed of, for example, a photodiode which is installed inside a shading-box having a slit of 1×10 mm. FIG. 8 is an electric circuit diagram of the measuring unit 20. In this case, the measuring result is detected as voltage $V_{out}$ which is generated by photodiode PD and resistance R which are connected in parallel.

Figure 10:
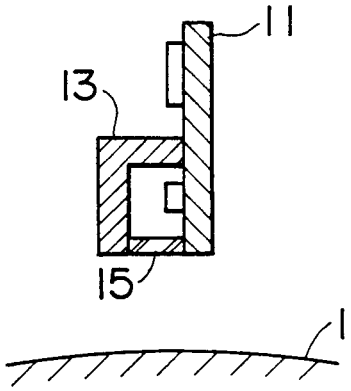
FIG. 10 is a sectional view taken on line A—A' in FIG. 9.
Figure 9:
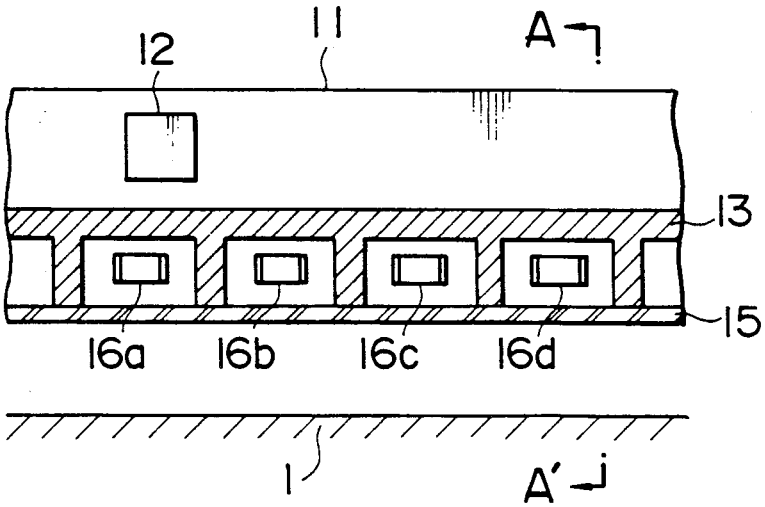
FIG. 9 is a sectional view of another example of the charge-eliminating apparatus of the present invention.

FIG. 9 is a sectional view of another example of the present invention, wherein the view is taken in the direction of the substrate. FIG. 10 is a sectional view taken in the axial direction of the photoreceptor drum 1 (a sectional view taken on line A—A' in FIG. 9).

In this example, the surface packaged part LED 16 is used instead of the bare chip LED 14 which is used in the charge-eliminating apparatus shown in FIG. 1.

In this example the difference of the distribution of the amount of light is hardly produced on the photoreceptor drum 1 in the same way as the example shown in FIG. 7.

In the composition described above, the packaging of LED can be automatically and easily conducted and the throughput is increased, so that the cost can be reduced. When bare chips are used as the chip LEDs 14, the chip LEDs 14 can be packaged in the same manufacturing process as the bare chip LEDS. When the surface packaged parts LEDs are used as the chip LEDs 14, the chip LEDs 14 can be packaged in the same packaging process as the common surface packaging process (the packaging process of chip condensers or chip resistances). For that reason, in this example there is not needed such an exclusive process as the process which is needed in the case of packing mold LEDs.

According to the experiment made by the inventors, the best distribution of the amount of light was achieved under the conditions explained as follows.

| | |
|---|---|
| Interval of chip LEDs | 6 mm |
| Position of chip LEDs (Center of the chips) | 3 mm from the edge of the substrate |
| Thickness of the LED house partition (the member which separates LEDs) | 1 mm |
| Thickness of the LED cover | 0.5 mm |
| Reflectance of the inner surface of the LED house | 80% |

Figure 11:
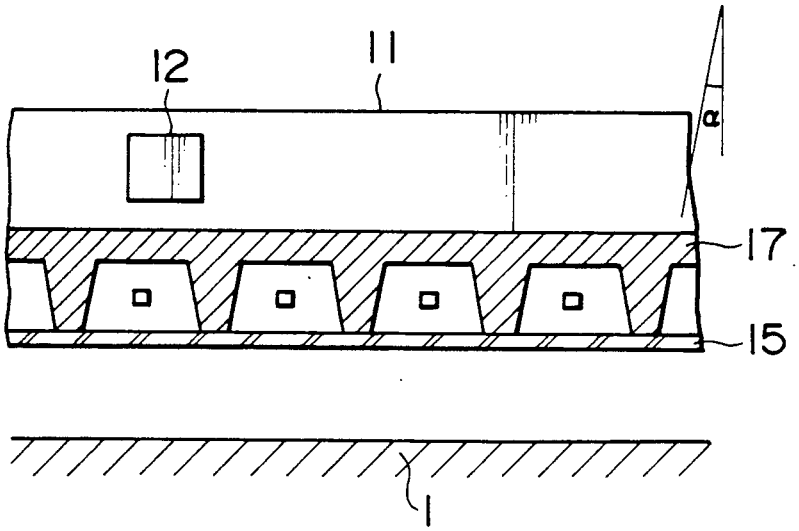
FIG. 11 is a sectional view which shows another example of the present invention.

FIG. 11 is a sectional view of another example of the present invention which is taken in the direction of the print substrate.

In this example, the LED house 17 provided with a partition having the expanding angle $\alpha$ which is expanded in the direction of the photoreceptor drum 1 as illustrated in FIG. 11, is provided instead of the LED house 13 shown in FIG. 1. As a result, the reflection on the partition of the LED house 17 can be further utilized, so that the difference of the distribution of the amount of light on the drum surface is further decreased.

The best result was obtained under the following conditions.

| | |
|---|---|
| Interval of chip LEDs | 6 mm |
| Position of chip LEDs | 4 mm from the edge of the substrate |
| Thickness of the edge portion of the partition of the LED house | 1 mm |
| Expansion angle $\alpha$ | 10° |
| Thickness of the LED cover | 0.5 mm |
| Reflectance of the inner | 80% |

-continued

| | |
|---|---|
| surface of the LED house | |

Figure 12:
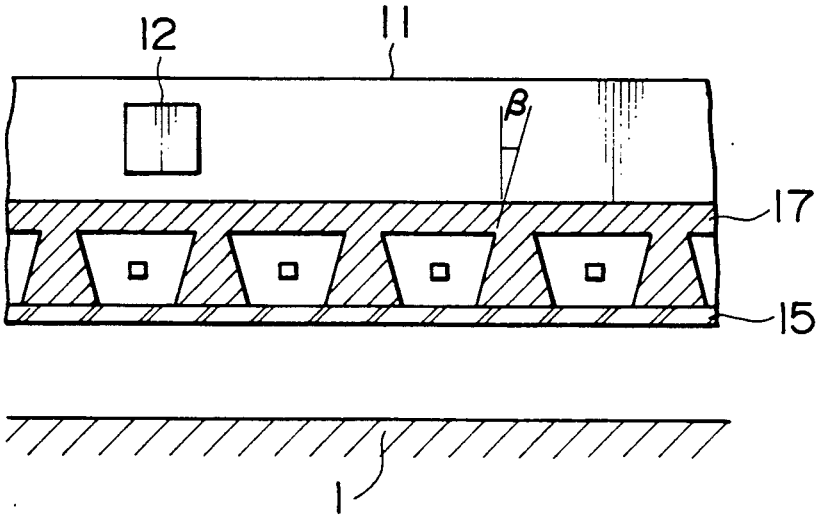
FIG. 12 is a sectional view which shows another example of the present invention.

FIG. 12 is a sectional view of another example of the present invention which is taken in the direction of the print substrate.

In this example, the LED house 17 provided with a partition having closing angle $\beta$ is installed instead of the LED house 17 provided with a partition having expanding angle as illustrated in FIG. 11. In this example, the irradiating opening is provided in such a manner that it closes in the direction of the photoreceptor drum 1 as illustrated in FIG. 12. As a result, while the light reflected on the partition surface is effectively utilized, the emitted light from the next LED can be positively shaded, so that the distribution of the amount of light can be made uniform and the contour of the charge-eliminating zone can be made clear.

The best result could be obtained under the following conditions.

| | |
|---|---|
| Interval of chip LEDs | 6 mm |
| Position of chip LEDs | 2 mm from the edge of the substrate |
| Thickness of the edge portion of the partition of the LED house | 2 mm |
| Closing angle $\beta$ of the partition | 10° |
| Thickness of LED cover | 0.5 mm |
| Reflectance of the inner surface of the LED house | 80% |

In the case of the LED house illustrated in FIG. 1, an excellent result could be obtained under the following conditions.

| | |
|---|---|
| Interval of chip LEDs | 6 mm |
| Position of chip LEDs | 3 mm from the edge of the substrate |
| Thickness of the partition of the LED house | 0.5 mm |
| Thickness of the LED cover | 0.5 mm |
| Reflectance of the inner surface of the LED house | 10% |

Specifically, the reflectance of the inner surface of the LED house can be further small by adjusting the thickness of the partition.

Figure 13:
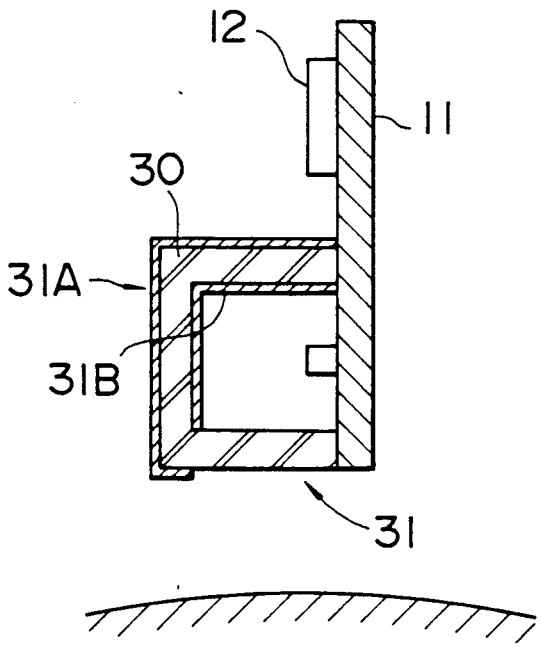
FIG. 13 is a sectional view which shows further another example of the charge-eliminating apparatus of the present invention.
Figure 14:
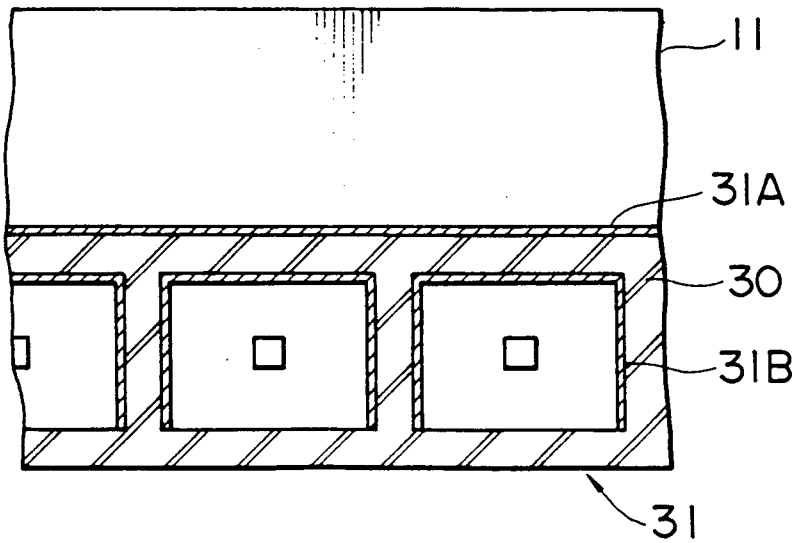
FIG. 14 is a sectional view taken in the direction of light irradiation in the example illustrated in FIG. 13.
Figure 15:
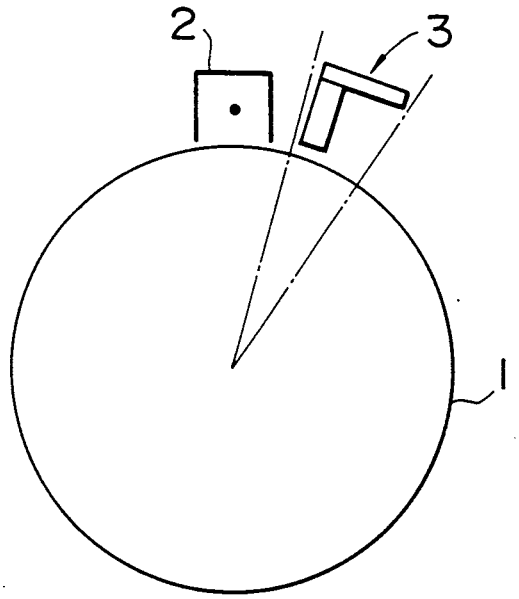
FIG. 15 is a side view which shows a conventional charge-eliminating apparatus and a photoreceptor.
Figure 16:
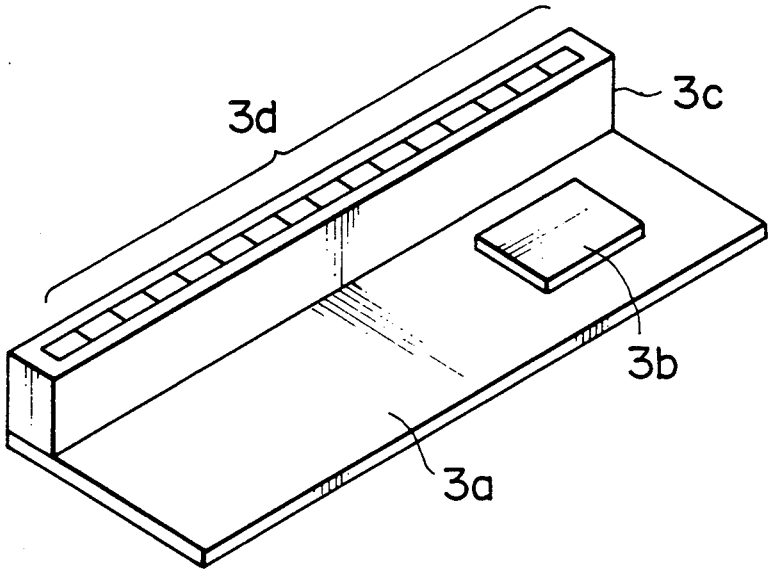
FIG. 16 is a perspective view which shows the appearance of the conventional charge-eliminating apparatus.
Figure 17:
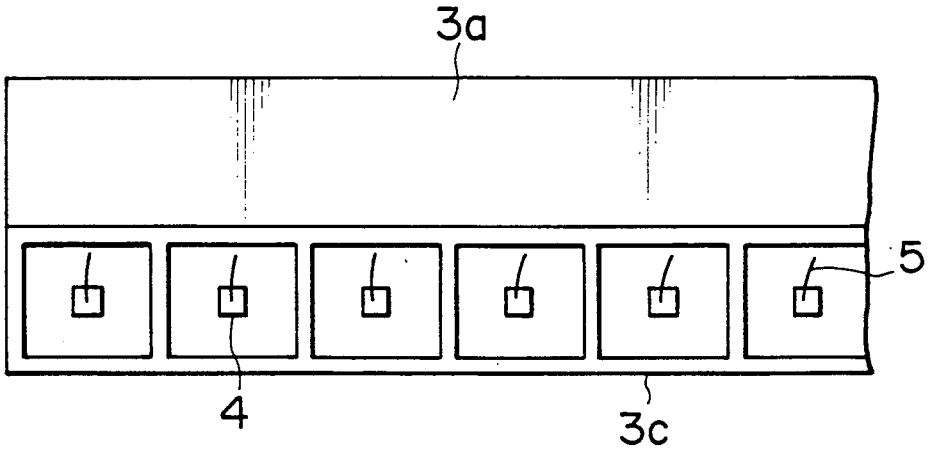
FIG. 17 is a view which shows the composition of the conventional charge-eliminating apparatus in detail.
Figure 18:
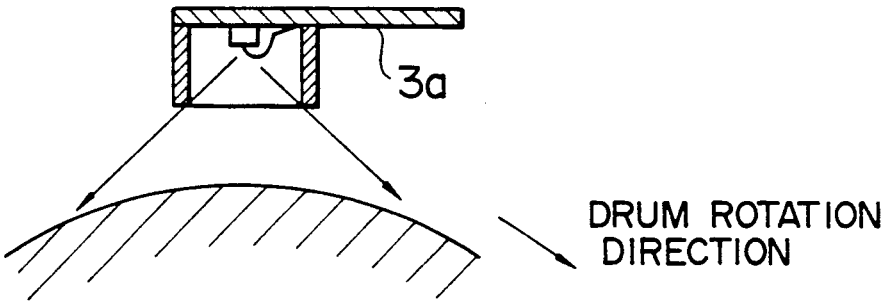
FIG. 18 is a schematic illustration which explains the irradiating angle of the light emitted from the conventional charge-eliminating apparatus, wherein the irradiating angle in the direction of drum rotation is illustrated in the drawing.
Figure 19:
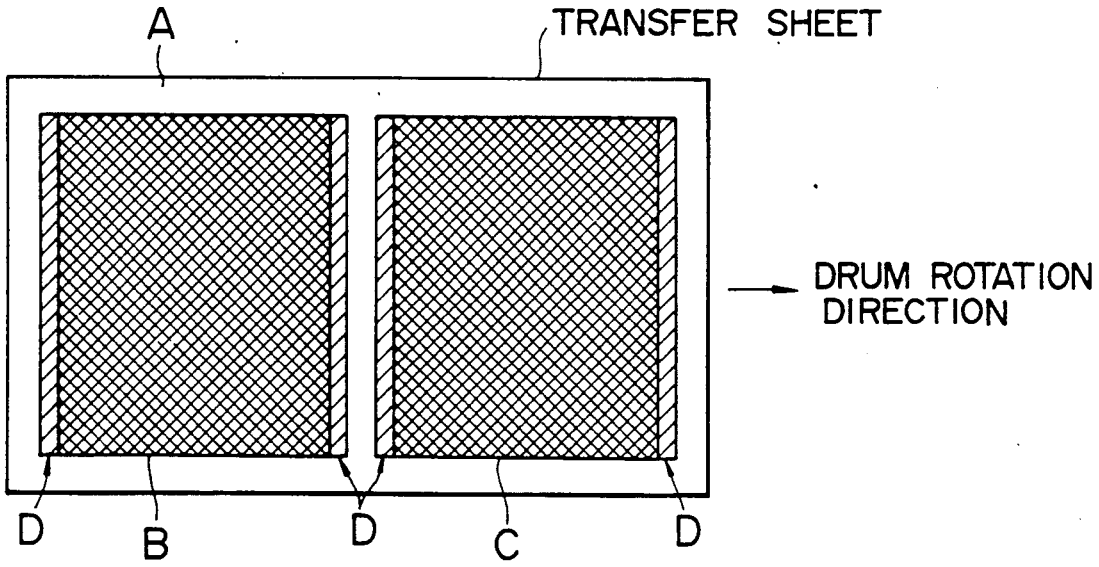
FIG. 19 is a schematic illustration which shows the state of charge-elimination on a transfer paper.
Figure 20:
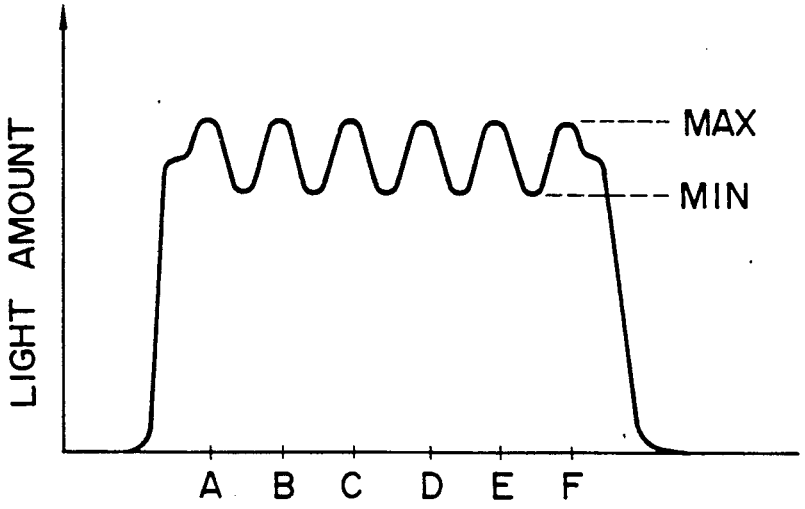
FIG. 20 is a characteristic diagram which shows the characteristic of the distribution of the amount of light.

FIG. 13 and FIG. 14 illustrate another example of the present invention. In this example, the portions corresponding to the conventional LED cover and LED house are integrally formed by transparent material (the transparent LED house 30), and after that the portion which corresponds to the LED house (the portion except the window portion) is painted with opaque paint. Specifically, the coated films 31A,31B composed of opaque paint are formed on at least one of the inner surface and the outer surface of the LED house except the window portion 31. The paint having necessary reflectance and luster may be chosen. In this case the number of parts is decreased, so that the cost can be reduced and the the reliability can be increased. The manufacturing process can be simplified by such a procedure that: the coated films 31A,31B are formed beforehand on the transparent LED house 30; after that the transparent LED house 30 is provided to the print substrate 11.

In the above-described example, the lamp house partition is provided to each LED. However, it is possible that the partition is provided in accordance with the size of a transfer paper or the boundary of the charge-eliminating zone, and that the partition is not provided to other portions.

The present invention is to provide a charge-eliminating apparatus which is located so that it can face the surface of a photoreceptor drum and eliminates the unnecessary charge on the photoreceptor drum by irradiating the photoreceptor drum surface, and which comprises: an IC for driving a LED; a print substrate whose line-shaped edge surface faces the photoreceptor drum surface; a plurality of LEDs which are arranged on the print substrate in parallel with the above-described line-shaped edge face; an opening on the side of the line-shaped edge face of the print substrate; and a LED house having a partition at a predetermined position.

As a result, it has become possible to restrict the height of the LED house and to provide a thin charge-eliminating apparatus. At the same time it has become possible to restrict the expansion of the amount of irradiating light in the direction of the photoreceptor rotation, and the difference of the distribution of the amount of light is not produced. Accordingly the charge-eliminating apparatus of the invention is so small that it is suitable for a photoreceptor of small size. The present invention has realized a charge-eliminating apparatus for use in a copier, which is characterized in that: the contour of a charge-eliminating zone can be made clear; and the difference of the distribution of the amount of light with regard to a photoreceptor drum is not produced.

What is claimed is:

1. An electrostatic recording apparatus, comprising:

means for carrying an image having a surface capable of being electrostatically charged to form an electrostatic latent image; and means for eliminating electrostatic charge on at least a portion of the surface of the image carrying means, the eliminating means including a circuit board for holding an electrical circuit on a surface thereof, the circuit board having an edge disposed to face toward the surface of the image carrying means, 'a plurality of light emitting elements, each light emitting element being positioned on the circuit board so as to emit light parallel to the surface of the circuit board toward the surface of the image carrying means, and a housing having a plurality of compartments, each compartment being defined by partition members positioned between predetermined ones of the plurality of light emitting elements and having an opening to allow the emitted light to radiate parallel to the surface of the circuit board toward the surface of the image carrying means.

2. The apparatus of claim 1, wherein the partition members include a plurality of pairs of opposing side walls for forming the compartments, a distance between the opposing side walls decreasing as the side walls approach the edge.

3. The apparatus of claim 1, wherein the partition members include a plurality of pairs of opposing side walls for forming the compartments, a distance between the opposing side walls increasing as the side walls approach the edge.

4. The apparatus of claim 1, wherein each of the compartments comprises a first sub-compartment which accommodates at least one of the plurality of light emitting elements and a second sub-compartment which forms a passage for allowing the emitted light to radiate into the opening, the second sub-compartment being sized smaller than the first sub-compartment.

5. The apparatus of claim 1, wherein internal surfaces of the compartments are white.

6. The apparatus of claim 1, wherein the light emitting element is a bare chip LED.

7. The apparatus of claim 1, wherein the light emitting element is a packaged LED.

8. An electrostatic recording apparatus, comprising:

means for carrying an image having a surface capable of being electrostatically charged to form an electrostatic latent image; and means for eliminating electrostatic charge on at least a portion of the surface of the image carrying means to inhibit formation of an electrostatic latent image, the eliminating means including a circuit board for holding an electrical circuit on a surface thereof, the circuit board having an edge disposed to face toward the surface of the image carrying means, a plurality of light emitting elements, each light emitting element being a bare chip LED and being positioned on the circuit board so as to emit light parallel to the surface of the circuit board toward the surface of the image carrying means, and a housing having a plurality of compartments, each compartment enclosing at least one of the plurality of light emitting elements on the circuit board and having an opening at the edge to allow the emitted light to radiate parallel to the surface of the circuit board toward the surface of the image carrying means.

9. An electrostatic recording apparatus, comprising:

means for carrying an image having a surface capable of being electrostatically charged to form an electrostatic latent image; and means for eliminating electrostatic charge on at least a portion of the surface of the image carrying means to inhibit formation of an electrostatic latent image, the eliminating means including a circuit board for holding an electrical circuit on a surface thereof, the circuit board having an edge disposed to face toward the surface of the image carrying means, a plurality of light emitting elements, each light emitting element being a packaged LED and being positioned on the circuit board so as to emit light parallel to the surface of the circuit board toward the surface of the image carrying means, and a housing having a plurality of compartments, each compartment enclosing at least one of the plurality of light emitting elements on the circuit board and having an opening at the edge to allow the emitted light to radiate parallel to the surface of the circuit board toward the surface of the image carrying means.

* * * * *